US007283031B2

(12) United States Patent
Huang

(10) Patent No.: US 7,283,031 B2
(45) Date of Patent: Oct. 16, 2007

(54) CIRCUIT BREAKER

(76) Inventor: Albert Huang, 3F, No. 146, Sec. 4, Chungking N. Rd., Taipei (TW)

( * ) Notice: Subject to any disclaimer, the term of this patent is extended or adjusted under 35 U.S.C. 154(b) by 319 days.

(21) Appl. No.: 11/145,960

(22) Filed: Jun. 7, 2005

(65) Prior Publication Data

US 2006/0273875 A1 Dec. 7, 2006

(51) Int. Cl.
*H01H 37/70* (2006.01)
*H01H 37/52* (2006.01)

(52) U.S. Cl. ..... 337/66; 337/56; 337/72

(58) Field of Classification Search ..... 337/56, 337/72, 66, 94; 200/339, 341
See application file for complete search history.

(56) References Cited

U.S. PATENT DOCUMENTS

| | | | | | |
|---|---|---|---|---|---|
| 3,932,829 | A * | 1/1976 | Ellenberger | 337/49 |
| 4,258,349 | A * | 3/1981 | Flory | 337/46 |
| 4,329,669 | A * | 5/1982 | Krasser et al. | 335/20 |
| 4,338,586 | A * | 7/1982 | Scanlon | 337/74 |
| 4,345,233 | A * | 8/1982 | Matthies | 337/75 |
| 4,528,538 | A * | 7/1985 | Andersen | 337/43 |
| 4,833,439 | A * | 5/1989 | Bowden et al. | 337/68 |
| 4,922,219 | A * | 5/1990 | Bakhaus et al. | 337/74 |
| 5,089,799 | A * | 2/1992 | Sorenson | 337/68 |
| 5,223,813 | A * | 6/1993 | Cambreleng et al. | 337/66 |
| 5,262,748 | A * | 11/1993 | Tsung-Mou | 337/66 |
| 5,264,817 | A * | 11/1993 | Sorenson | 337/68 |
| 5,491,460 | A * | 2/1996 | Krasser et al. | 337/70 |
| 5,539,371 | A * | 7/1996 | Yu | 337/66 |
| 5,760,672 | A * | 6/1998 | Wang | 337/79 |
| 5,892,426 | A * | 4/1999 | Huang | 337/59 |
| 6,275,134 | B1 * | 8/2001 | Chen | 337/37 |
| 6,307,460 | B1 * | 10/2001 | Yu | 337/37 |
| 6,400,250 | B1 * | 6/2002 | Wang | 337/66 |
| 6,445,273 | B1 * | 9/2002 | Yu | 337/37 |
| 6,456,185 | B1 * | 9/2002 | Yu | 337/37 |
| 6,512,441 | B1 * | 1/2003 | Yu | 337/37 |
| 6,525,639 | B1 * | 2/2003 | Cheng | 337/37 |
| 6,552,644 | B2 * | 4/2003 | Yu | 337/66 |
| 6,563,414 | B2 * | 5/2003 | Yu | 337/66 |
| 6,577,221 | B1 * | 6/2003 | Wang | 337/59 |
| 6,617,952 | B1 * | 9/2003 | Yu | 337/94 |
| 6,621,402 | B2 * | 9/2003 | Huang | 337/66 |

(Continued)

FOREIGN PATENT DOCUMENTS

FR 2605142 A1 * 4/1988

*Primary Examiner*—Anatoly Vortman
(74) *Attorney, Agent, or Firm*—Hershkovitz & Associates, LLC; Abe Hershkovitz

(57) ABSTRACT

A breaker has a first conducting strip and a second conducting strip respectively mounted on a lower end of a shell; a first terminal mounted on the second conducting strip; a bimetal strip securely provided on a first conducting strip; a second terminal mounted on a tip of the bimetal strip and detachably connected to the first terminal; a button provided on an upper end of the shell; a finger pivotally provided under the curved spring; and a lever with a smooth surface provided between the bimetal strip and the finger wherein an end of the lever is bent to form an angle. Hence, the finger can slide on the smooth surface of the lever so that the button can completely return to an original status. Furthermore, when the angle is small, the finger counter clockwise rotates with a small stored power of the bimetal strip.

2 Claims, 4 Drawing Sheets

U.S. PATENT DOCUMENTS 6,664,884 B1 * 12/2003 Yu ..... 337/59
6,674,033 B1 * 1/2004 Wang ..... 200/334
6,714,116 B1 * 3/2004 Sang et al. ..... 337/68
6,734,779 B2 * 5/2004 Yu ..... 337/59
6,788,186 B1 * 9/2004 Yu ..... 337/66
6,864,453 B1 * 3/2005 Yu ..... 200/520
6,940,389 B1 * 9/2005 Yu ..... 337/66
7,030,726 B2 * 4/2006 Yu ..... 337/66
2003/0160679 A1 * 8/2003 Yu ..... 337/37
2005/0140489 A1 * 6/2005 Kuo ..... 337/66

* cited by examiner

CIRCUIT BREAKER

BACKGROUND OF THE INVENTION

1. Field of the Invention

The present invention relates to a circuit breaker, and more particularly to a circuit breaker which can interrupt an excessively high electrical current consumption.

2. Description of Related Art

A circuit breaker is provided in a distribution box to prevent a high electrical current consumption from causing an accident. The circuit breaker is composed of a shell, a first and a second conducting strip provided in the shell, and a bimetal strip securely mounted on an upper end of the first conducting strip. The bimetal strip, i.e., two metal flats which have different thermal expansion factors, can electrically connect to the second conducting strip.

When an electrical current is excessively high and generates dangerous heat, the bimetal strip becomes heated and distorts, whereby a tip of the bimetal strip separates from the second conducting strip. Hence, the electrical current circuit is interrupted to prevent the overload of the current consumption.

Whether the circuit breaker has an action function depends on the flexibility of the bimetal strip. The bimetal strip of a conventional circuit breaker is pressed by a button. If a distortion power of the bimetal strip caused by the heavy current consumption is bigger than a friction from the button, the bimetal strip can separate from the second conducting strip. If the friction from the button is too big for the bimetal strip to act quickly, a product may be damaged because of the heavy current not being timely interrupted.

With reference to FIG. 5, a conventional breaker has a shell (not numbered), a first conducting strip (60) and a second conducting strip (61) respectively provided in a lower end of the shell. A first terminal (62) is mounted on an upper tip of the second conducting strip (61) and the first conducting strip (60) is connected to a first tip of a horizontal bimetal strip (63). A second tip of the bimetal strip (63) is mounted with a second terminal (64) which detachably connects to the first terminal (62).

A button (70) is mounted on an upper end of the shell and a curved spring (71) is provided under the button (70). A finger (72), a lower end of which is connected to the second tip of the bimetal strip (63), is mounted under the curved spring (71). An angle (A) is formed between the curved spring (71) and the second tip of the bimetal strip (63).

With further reference to FIG. 6, when the button (70) is in the 'current flow' mode and the current consumption then becomes excessive, the second terminal (64) separates from the first terminal (62) thereby the finger (71) being counter clockwise rotated.

With reference to FIG. 7, when the pressure on the button (70) is released, the curved spring (71) compresses against the finger (72) to clockwise rotate so that the button (70) moves to the 'current interruption' mode.

However, disadvantages of the conventional circuit breaker are described as follows:

1. The finger (72) can not pivot smoothly corresponding to the bimetal strip (63) if the bimetal strip (63) does not have a smooth surface such that the button can not move to the 'current interruption' mode completely when the pressure is released.

2. The finger (72) is directly compressed against the bimetal strip (63) to enable the bimetal strip (63) to return to the 'current interruption' mode such that the finger (72) should incline substantially corresponding to the bimetal strip (63). Furthermore, the bimetal strip (63) should have a big stored power to enable the finger (71) to rotate thereby having a small practicability.

Therefore, the invention provides a circuit breaker to mitigate or obviate the aforementioned problems.

SUMMARY OF THE INVENTION

The main objective of the present invention is to provide a circuit breaker wherein a button can appropriately move to a 'current interruption' mode and a finger with a small stored power pivots from a bimetal strip.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
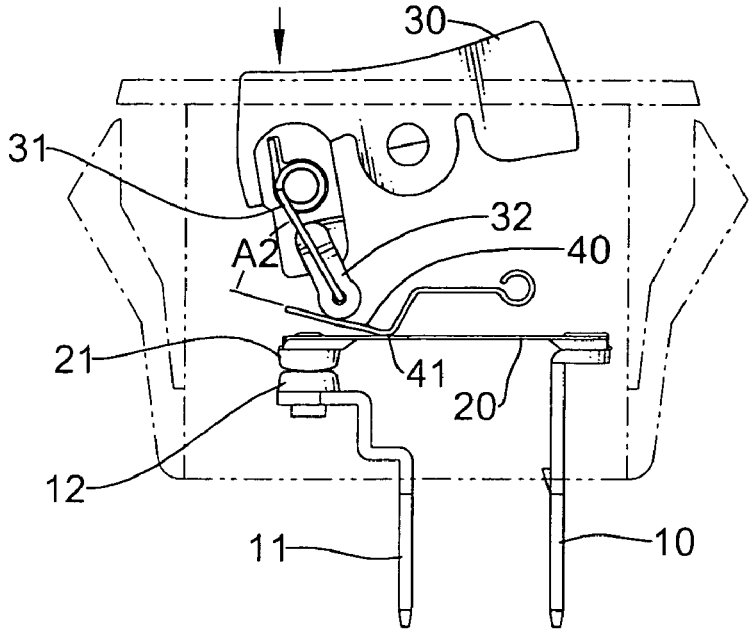
FIG. 1 is a side view of a circuit breaker in a 'current flow' mode in accordance with the present invention.

With reference to FIG. 1, a circuit breaker comprises a shell, and a first conducting strip (10) and a second conducting strip (11) respectively provided on a lower end of the shell. A first terminal (12) is mounted on an upper end of the second conducting strip (11) and a bimetal strip (20) is horizontally and securely mounted on an upper end of the first conducting strip (10) wherein a first tip of the bimetal strip (20) is connected to the first conducting strip (10) and a second terminal (21) securely connects to a second tip of the bimetal strip (20) and is detachably in contact with the first terminal (12).

A button (30) is pivotally mounted on an upper end of the shell, a curved spring (31) is mounted on a lower end of the button (30) and a finger (32) is provided on a lower end of the curved spring (31). A lever (40), which has a smooth surface, is mounted between the finger (32) and the bimetal strip (20). The lever (40) is bent to form a pivot point (41), which is formed in a middle portion of the lever (40) and in contact with a middle portion of the bimetal strip (20).

Figure 2:
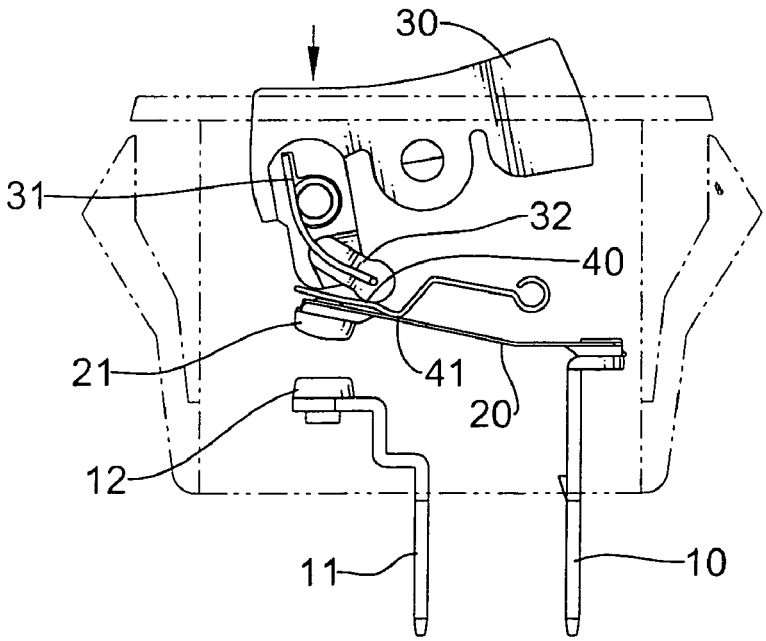
FIG. 2 is a side view of the circuit breaker in first stage of a 'current interruption' mode in accordance with the present invention.

With reference to FIG. 1, when the button (30) is in an actuated position and the current flow is normal, the finger contacts an angled end of the lever (40) and the first terminal (12) contacts the second terminal (21). With further reference to FIG. 2, when the button (30) is still in an actuated position and the current flow is heavy, the second terminal (21) is separated from the first terminal (12) due to the deformation of the bimetal strip (20), and the low physical resistance of the angled end of the lever (40) is overcome, such that the first stage of the 'current interruption' mode is entered, yet the button (30) remains in its actuated position. Hence, the angled end of the lever (40) attaches to the first tip of the bimetal strip (20) and pushes the finger (32) to counter clockwise rotate. Then the ease of deformation of the angled end of the lever (40) permits the second terminal (21) to continue moving and overcome the greater resistance of the button (30).

Figure 3:
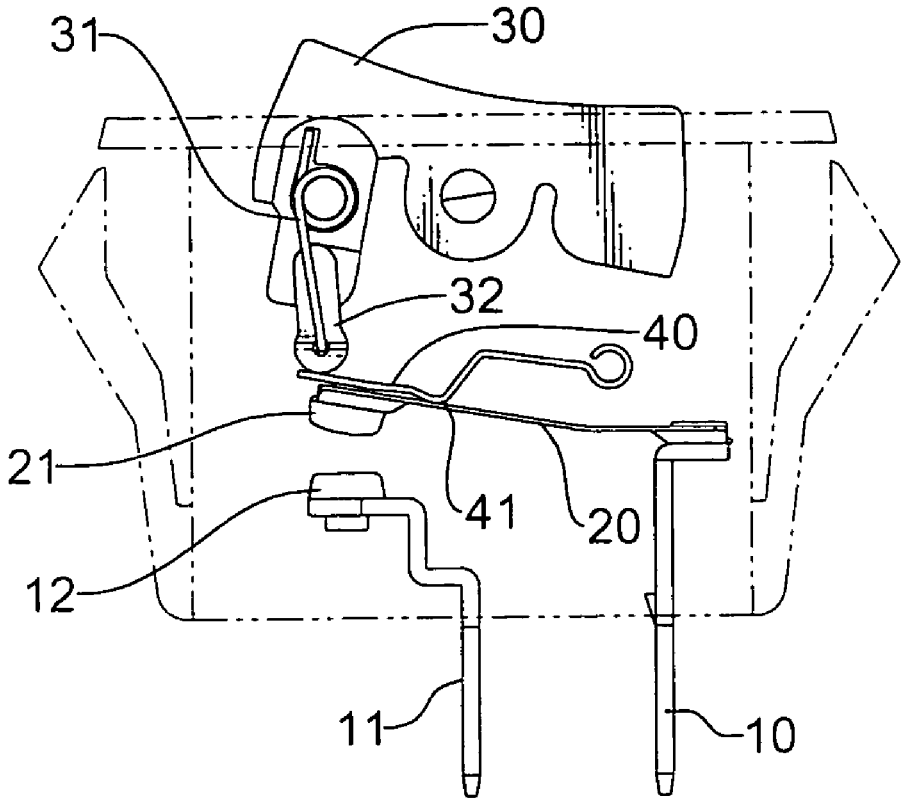
FIG. 3 is a side view of the circuit breaker in a second stage of the 'current interruption' mode in accordance with the present invention.

With reference to FIG. 3, when the pressure from the button (30) is released, the curved spring (31) can press against the finger (32) to clockwise rotate and the finger (32) slides on the smooth surface of the lever (40) so that the button (30) can move to the second and final stage of the 'current interruption' mode.

Figure 4:
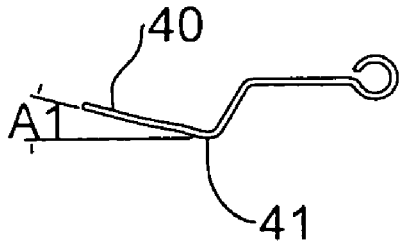
FIG. 4 is a side view of a lever of the circuit breaker in accordance with the present invention.
Figure 5:
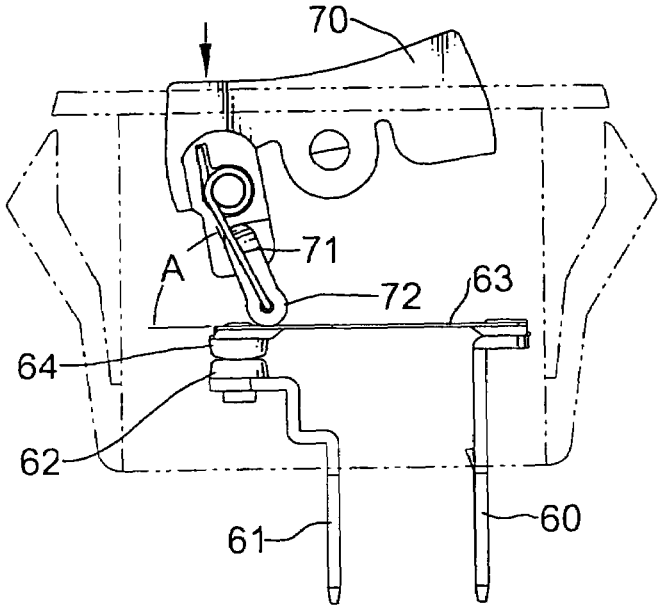
FIG.5 PRIOR ART
FIG. 5 is a side view of a conventional circuit breaker in a 'current flow' mode.
Figure 6:
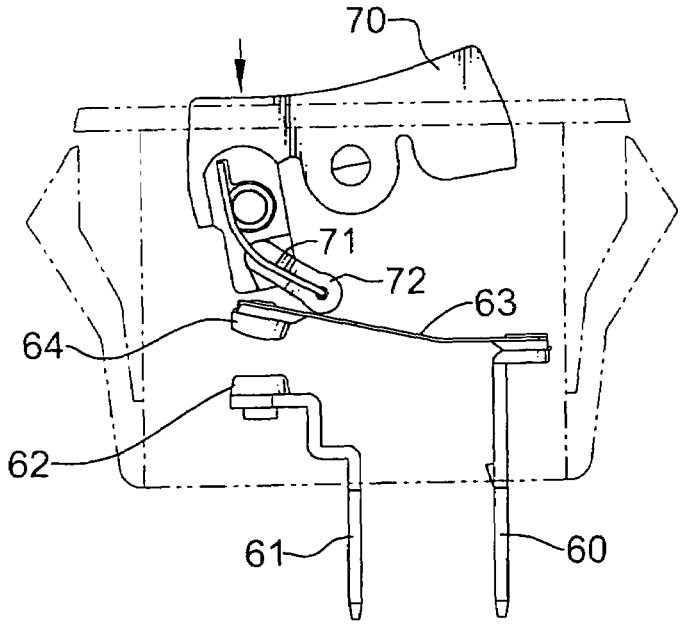
FIG.6 PRIOR ART
FIG. 6 is a side view of the conventional circuit breaker in a first stage of a 'power interruption' mode.
Figure 7:
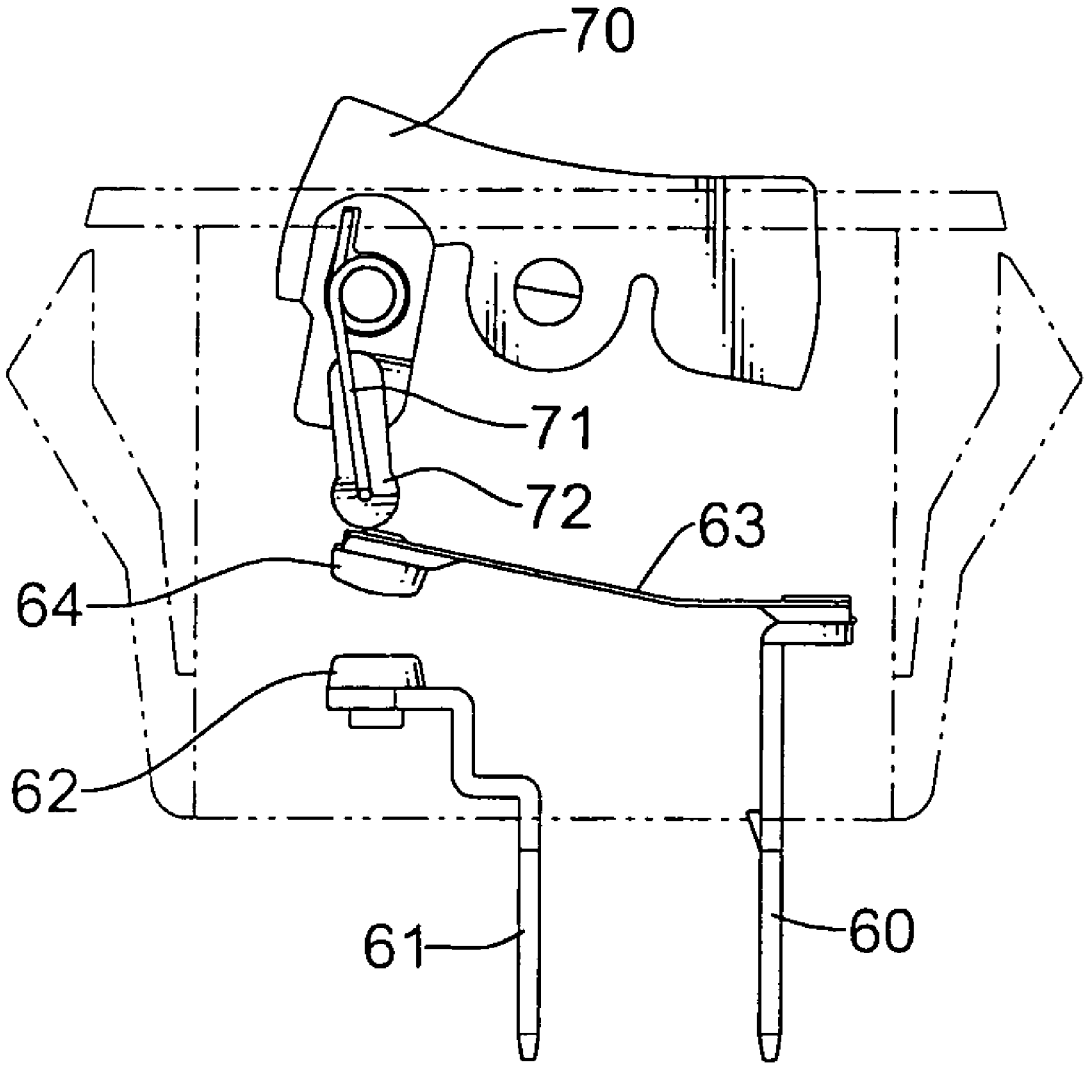
FIG.7 PRIOR ART
FIG. 7 is a side view of the conventional circuit breaker in a second and final stage of the 'power interruption' mode.

With reference to FIG. 4, an angle (A1) between a tip of the lever and a level surface can be changed with the distortion of the lever (40). With further reference to FIG. 1, when an angle (A2) between the tip of the lever (40) and the lower portion of the curved spring (31) is small, the finger (32) can counter clockwise rotate only with a small power of the bimetal strip (20) to overcome a stored force of the curved spring (31).

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A circuit breaker comprising:

a shell;

a first conducting strip (10) and a second conducting strip (11) respectively mounted on a lower end of the shell;

a first terminal (12) mounted on the second conducting strip (11);

a bimetal strip (20) securely provided on the first conducting strip (10);

a second terminal (21) mounted on a tip of the bimetal strip (20) and detachably connected to the first terminal (12);

a button (30) pivotally mounted on an upper end of the shell and having an engaging end;

a curved spring (31) having an upper portion secured to the engaging end of the button (30) and a lower portion;

a finger (32) mounted around the lower portion of the curved spring (31); and a lever (40) with a smooth surface mounted between the bimetal strip (20) and the finger (32) wherein a first end of the lever (40) is bent to form an angle and a second end of the lever is secured to the shell, whereby in a first stage of a current interruption mode, a first low physical resistance from the first end of the lever permits movement of the second terminal away from contact with the first terminal, whereby the button does not move from an actuated position, and in a second stage of the current interruption mode, the second terminal continues to move away from the first terminal to overcome a high physical resistance from the button such that the button moves to a de-actuated position.

2. The circuit breaker as claimed in claim 1, wherein a pivot point is formed in a middle portion of the lever (40).

* * * * *